US010182663B2

(12) United States Patent
Chen et al.

(10) Patent No.: US 10,182,663 B2
(45) Date of Patent: Jan. 22, 2019

(54) FOLDING COT

(71) Applicant: Oxford Space Structures Ltd, Chilton, Didcot, Oxfordshire (GB)

(72) Inventors: Fujia Chen, London (GB); Zhong You, Oxford (GB); Wouter Horstink, Den Haags (NL); Marco Van Leeuwen, Den Haags (NL)

(73) Assignee: OXFORD SPACE STRUCTURES LTD, Oxfordshire (GB)

( * ) Notice: Subject to any disclaimer, the term of this patent is extended or adjusted under 35 U.S.C. 154(b) by 0 days.

(21) Appl. No.: 15/110,522

(22) PCT Filed: Aug. 20, 2015

(86) PCT No.: PCT/GB2015/052427
§ 371 (c)(1),
(2) Date: Jul. 8, 2016

(87) PCT Pub. No.: WO2016/116727
PCT Pub. Date: Jul. 28, 2016

(65) Prior Publication Data

US 2017/0303702 A1 Oct. 26, 2017

(30) Foreign Application Priority Data

Jan. 19, 2015 (GB) ..... 1500868.3

(51) Int. Cl.
*A47D 13/06* (2006.01)
*A47D 7/00* (2006.01)
*A47D 15/00* (2006.01)

(52) U.S. Cl.
CPC ..... *A47D 13/063* (2013.01); *A47D 7/002* (2013.01); *A47D 15/001* (2013.01)

(58) Field of Classification Search
CPC .. A47D 13/061; A47D 13/063; A47D 13/068; A47D 15/001; A47D 15/003
See application file for complete search history.

(56) References Cited

U.S. PATENT DOCUMENTS 250,614 A * 12/1881 Wilbur ..... A47D 13/063 297/44
1,211,730 A * 1/1917 Lucas ..... A47D 13/063 5/99.1

(Continued)

FOREIGN PATENT DOCUMENTS

AU 590 709 B2 11/1989
DE 3235394 A 3/1984

(Continued)

OTHER PUBLICATIONS

International Search Report for corresponding International App No. PCT/GB2015/052427 dated Oct. 2, 2015; 4 pages.

(Continued)

*Primary Examiner* — Nicholas F Polito
*Assistant Examiner* — Abigail R Hymel
(74) *Attorney, Agent, or Firm* — Patterson Thuente Pedersen, P.A.

(57) ABSTRACT

A foldable cot including a base attached to a first end and a second end and side-bars connected between the first and second ends above opposite sides of the base, with the first side-bar 0 positioned further from the base than the second side-bar, and the side-bars hinged such that they may fold toward one another, and the base hinged so that it may fold towards the first and second side-bars, such that folding of the base causes folding of the side-bars, with the cot moveable between a first configuration in which the base, first, and second side-bars are substantially un-folded, into a second configuration in which the base is folded in the direction of the first and second side-bars, the first and (Continued)

second side-bars are folded such that the first side-bar folds above the second side-bar, and the first and second ends are brought together with the folded base and the folded first and second side-bars between them.

22 Claims, 9 Drawing Sheets

(56) References Cited

U.S. PATENT DOCUMENTS

| | | | | |
|---|---|---|---|---|
| 2,594,677 | A | 4/1952 | Opie | |
| 3,094,714 | A * | 6/1963 | Lewis | A47D 7/002 5/99.1 |
| 3,722,009 | A * | 3/1973 | Hrynda | A47D 7/002 5/93.1 |
| 3,800,341 | A | 4/1974 | Davanzo | |
| D294,894 | S | 3/1988 | D'Arcy | |
| 4,765,004 | A | 8/1988 | Kessel | |
| D304,523 | S | 11/1989 | Dillner | |
| 5,228,154 | A | 7/1993 | Brevi | |
| 5,544,864 | A * | 8/1996 | Gabriel-Lacki | A47D 7/002 256/25 |
| 5,553,336 | A | 9/1996 | Mariol | |
| 5,752,283 | A | 5/1998 | Arens | |
| 5,781,944 | A | 7/1998 | Huang | |
| 6,272,704 | B1 * | 8/2001 | Cutler | A47D 5/006 5/420 |
| 6,385,800 | B1 | 5/2002 | Chen | |
| 6,895,611 | B2 | 5/2005 | Thralson | |
| D520,262 | S | 5/2006 | Hsu | |
| D619,816 | S | 7/2010 | Chen | |
| 8,006,326 | B2 | 8/2011 | Thomas | |
| 8,177,445 | B2 * | 5/2012 | Jones | B41J 3/4071 16/291 |
| 8,595,870 | B1 * | 12/2013 | Lorenzo | A47D 13/063 5/98.1 |
| 9,332,860 | B2 | 5/2016 | Rong | |
| 2001/0001161 | A1 | 5/2001 | Warner | |
| 2002/0078499 | A1 | 6/2002 | Cheng | |
| 2002/0184705 | A1 | 12/2002 | Cheng | |
| 2006/0185082 | A1 * | 8/2006 | Casati Troutman | A47D 13/063 5/99.1 |
| 2006/0218725 | A1 | 10/2006 | Carpenter | |
| 2007/0101493 | A1 | 5/2007 | Campbell et al. | |
| 2007/0214576 | A1 * | 9/2007 | Espenshade | A47D 13/063 5/723 |
| 2008/0209631 | A1 * | 9/2008 | Thomas | A47D 5/00 5/99.1 |
| 2008/0271244 | A1 | 11/2008 | Bergkvist | |
| 2010/0138991 | A1 | 6/2010 | Hartenstine | |
| 2011/0031457 | A1 | 2/2011 | Thorne et al. | |
| 2012/0216346 | A1 | 8/2012 | Rampton | |
| 2014/0068857 | A1 | 3/2014 | Jackson | |
| 2016/0066705 | A1 | 3/2016 | Yaacoby | |
| 2016/0183698 | A1 | 6/2016 | Szymanski | |

FOREIGN PATENT DOCUMENTS

| | | | |
|---|---|---|---|
| EP | 0501086 | A1 | 9/1992 |
| EP | 1878365 | A1 | 1/2016 |
| GB | 164 886 | A | 6/1921 |
| WO | WO 2012/065619 | A1 | 5/2012 |

OTHER PUBLICATIONS

Written Opinion of the International Searching Authority for corresponding International App No. PCT/GB2015/052427 dated Oct. 2, 2015; 5 pages.

GB Search Report for GB1500868.3, dated May 20, 2015, 4 pages.

Maarten Langbroek, Coroflot, Published Jan. 8, 2015, SpaceCot babybed, Coroflot.com [online] Available from http://www.coroflot.com/maartenlangbroek/SpaceCot-babybed [Accessed May 19, 2015], 5 pages.

Application and File History for U.S. Appl. No. 29/566,492, filed May 31, 2016, Inventors: Chen et al.

Application and File History for U.S. Appl. No. 29/566,488, Inventor: Chen et al., filed May 31, 2016.

*Baby Space Travel Cot Launches—Thanks to Satellite Technology*, Science and Technology Facilities Council Press Release, dated Mar. 21, 2016, available at http: www.stfc.ac.uk/news/baby-space-travel-cot-launches-thanks-to-satellite-technology.

International Preliminary Report on Patentability, International Application No. PCT/GB2015/052427, dated Aug. 3, 2017, 8 pages.

* cited by examiner

FOLDING COT

RELATED APPLICATIONS

The present application is a National Phase entry of PCT Application No. PCT/GB2015/052427, filed Aug. 20, 2015, which claims priority to GB 1500868.3, filed Jan. 19, 2015, the contents of which are incorporated herein by reference in their entireties.

TECHNICAL FIELD

The present application relates to folding beds which may be stowed easily, including foldable cots for babies and infants which may be folded and transported easily.

BACKGROUND

It is desirable to have a cot for a baby or an infant which may be used when travelling or visiting, and such a cot must be both folded and transported easily. Various attempts have been made to provide such a cot, and two such cots are disclosed in EP1878365A1 and US2011/0031457A1. These cots employ folding mechanisms which use a complex tubular arrangement for the base. Further, the side-rails of the cots are foldable in a downward direction to move the cots into a stowed configuration. These two cots are both relatively complex to fold away, and do not allow for storage of the mattress within the cot when folded.

If the mattress may not be stowed within the cot when folded, it not only makes the cot more difficult to transport, and the mattress may become separated from the cot and subsequently lost or forgotten.

EP0501086A1 and US2008/0271244A1 both disclose more traditional cot arrangements, which are also difficult to fold and stow. Particularly, the cots shown in these documents are both complex to fold and unfold. Owing to their complex structures, these cots may also present a finger-trap hazard, which can be dangerous.

Prior art cot or infant bed arrangements are, in general, difficult to fold or move from a deployed configuration to a stowed configuration, large to stow, often require the mattress to be removed before it can be folded or stowed, and may present a finger trap or other injury hazard when being stowed.

Additionally, prior art cot or infant bed arrangements may take a considerable time to move from a deployed configuration to a stowed configuration, sometimes in excess of twenty minutes.

SUMMARY

Embodiments seek to alleviate the problems associated with prior art folding cots and infant beds.

Particularly, embodiments seek to improve upon prior art foldable cots, and includes a system to enable the sides of the cot to fold in a synchronous manner.

Accordingly, one aspect provides a foldable cot, the cot including a base attached to a first end and a second end, first and second side-bars connected between the first and second ends above opposite sides of the base, wherein the first side-bar is positioned further from the base than the second side-bar, the first and second side-bars are each hinged such that they may fold toward one another, the base is hinged so that it may fold towards the first and second side-bars, and the cot may be moved from a first configuration in which the base, first, and second side-bars are substantially un-folded into a second configuration in which the base is folded in the direction of the first and second side-bars, the first and second side-bars are folded such that the first side-bar folds above the second side-bar, and the first and second ends are brought together with the folded base and the folded first and second side-bars between them.

In an embodiment, the first and second side-bars are hinged at a mid-point.

Conveniently, the base is hinged at a mid-point.

Advantageously, the base is hinged parallel to the first and second ends.

In an embodiment, the first and second side-bars are mounted such that they may pivot with respect to the first and second ends.

Conveniently, the cot further comprises first and second side portions which are affixed to respective first and second side-bars and the base of the cot.

Advantageously, the first and second side portions are also attached to the base.

In an embodiment, the first and second side portions include at least one section formed of a mesh material.

Conveniently, the first and second side portions include at least one section formed of formed of a flexible material.

Advantageously, the hinges of the first and second side-bars may be locked in an unfolded position by way of respective first and second lock-outs when the cot is in the first position.

In an embodiment, the first and second lock-outs include a spring-loaded locking member.

Conveniently, the spring-loaded locking member includes a protruding portion which is biased into a locked configuration.

Alternatively, the first and second lock-outs are over-center lock-outs.

Advantageously, the base further includes a mattress which may be folded with the base of the cot.

In an embodiment, the mattress includes a hinged portion.

Alternatively, the mattress is formed of two parts.

Conveniently, the base further includes at least one base foot on an underside thereof.

Advantageously, the or each base foot is formed integrally with the hinge in the base.

In an embodiment, the first and second ends include respective first and second foot portions positioned at or near the base of the cot.

Conveniently, at least one of the first and second foot portions includes a wheel or castor.

Advantageously, when the cot is in the second configuration, the base and the side-bars are accommodated in recesses provided in the first and second ends.

In an embodiment, the base hinge is a living hinge.

Alternatively, the base hinge is a door-type hinge.

Conveniently, the first and second ends include a fixing mechanism such that, when the cot is in the second configuration, the first and second ends may be attached together.

Advantageously, the first and second ends include a cover, such that, when the cot is in the second configuration, the cover may be secured over the cot.

BRIEF DESCRIPTION OF THE DRAWINGS

Embodiments will now be described, by way of example only, with reference to the figures, in which.

DETAILED DESCRIPTION

Figure 1:
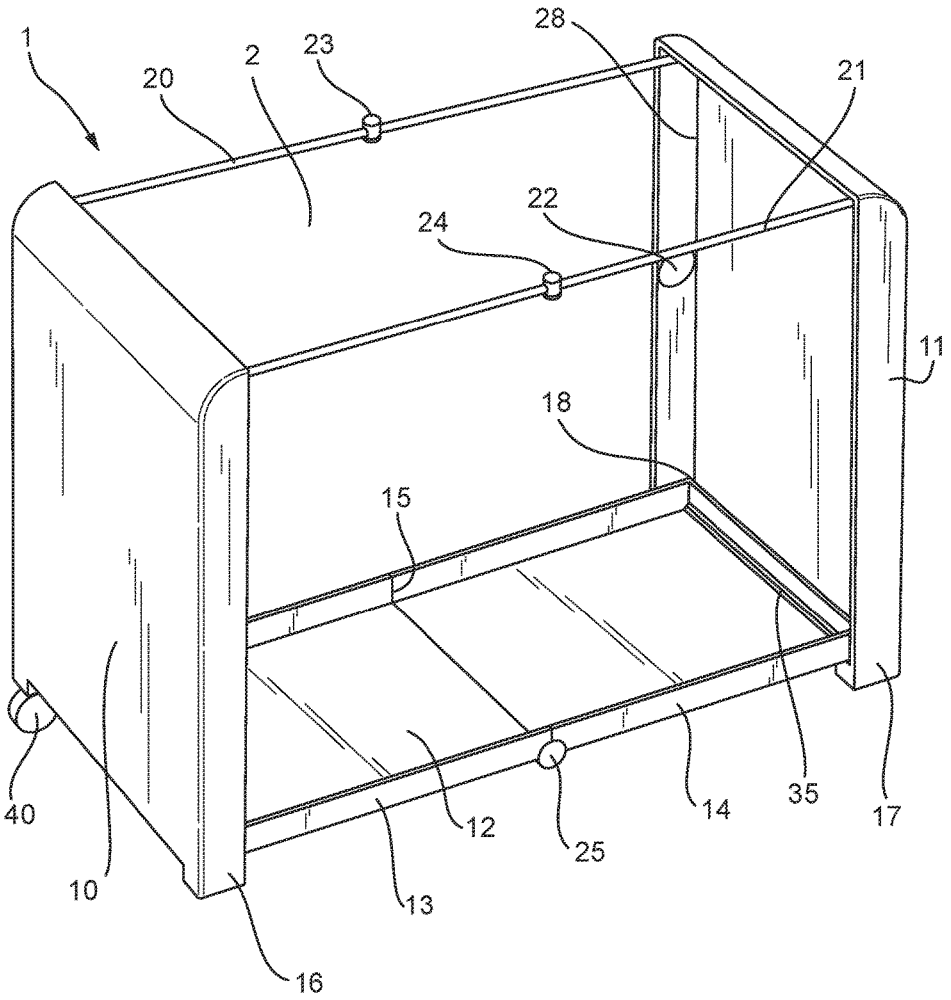
FIG. 1 shows a foldable cot according to an embodiment in a deployed configuration.

Turning firstly to FIG. 1, a cot according to an embodiment is shown. The cot 1 is shown in a deployed configuration, and is constructed such that it may be folded from the deployed configuration to a stowed configuration.

The cot 1 includes a first end 10, and a second end 11, affixed to a base 12. Further, two side-bars are provided, made up of a first side-bar 20 and a second side-bar 21. As can be seen, the side-bars 20, 21 are spaced away from the base 12, with the base 12 positioned at or near one end of the first and second ends 10, 11, and the side-bars 20, 21 positioned at or near the other end of the first and second ends 10, 11.

Side portions 30, 31 (not shown in FIG. 1, but shown in FIG. 3 and discussed in more detail later) may also be attached to the side bars 20, 21 and reach down to, and may be affixed to, the base 12 of the cot 1. The side portions 30, 31 serve to provide side-walls of the cot 1.

As can be seen, when in the deployed configuration, the ends 10, 11, the base 12, the two side-bars 20, 21, and the side portions 30, 31 of the cot 1 define an internal space 2 which may accommodate an occupant, likely a baby or an infant.

Both side-bars 20, 21 may include a hinge 23, 24 which can be located in the center of the side-bar, and the side-bars may also be rotatably affixed to the first and second ends 10, 11 by way of rotatable fixings 22 such that the side-bars may rotate with respect to the ends 10, 11.

The rotatable mountings, hinges, and side portions will be discussed in more detail later.

The base 12 of the cot 1 may be hinged such that it can be folded. In an embodiment, the hinge of the base 12 is provided at a center-line 15, parallel to the first and second ends 10, 11. Further, the base 12 may be formed of a single portion including a flexible portion which may be a 'living hinge' 15, or may be formed of a first base portion 13 and a second base portion 14, fixed together by a base hinge 25. The base hinge 25 may be a door hinge or any other suitable type of hinge.

To enable the base 12 to fold about the hinge 15, 25, each end of the base 12 is rotatably mounted with respect to the ends 10, 11, by way of end hinges 35 in an embodiment. The arrangement of the base hinges 15, 25, along with end hinges 35, is such that the base 12 may fold in an upward direction towards, and perpendicular to, the side-bars 21, 22. As with the base hinge 25, the end hinges 35 may be living hinges, door hinges, or any other suitable type of hinge.

Any one or more of the hinges 15, 25, 35 may be arranged such that, when the cot 1 is in the deployed configuration, they may be limited so they may not allow the cot 1 to move beyond the deployed configuration. This may improve the structural rigidity of the cot 1, and may also ensure that when the cot is moved between configurations, the movement is simple, quick, and predictable.

Figure 2A:
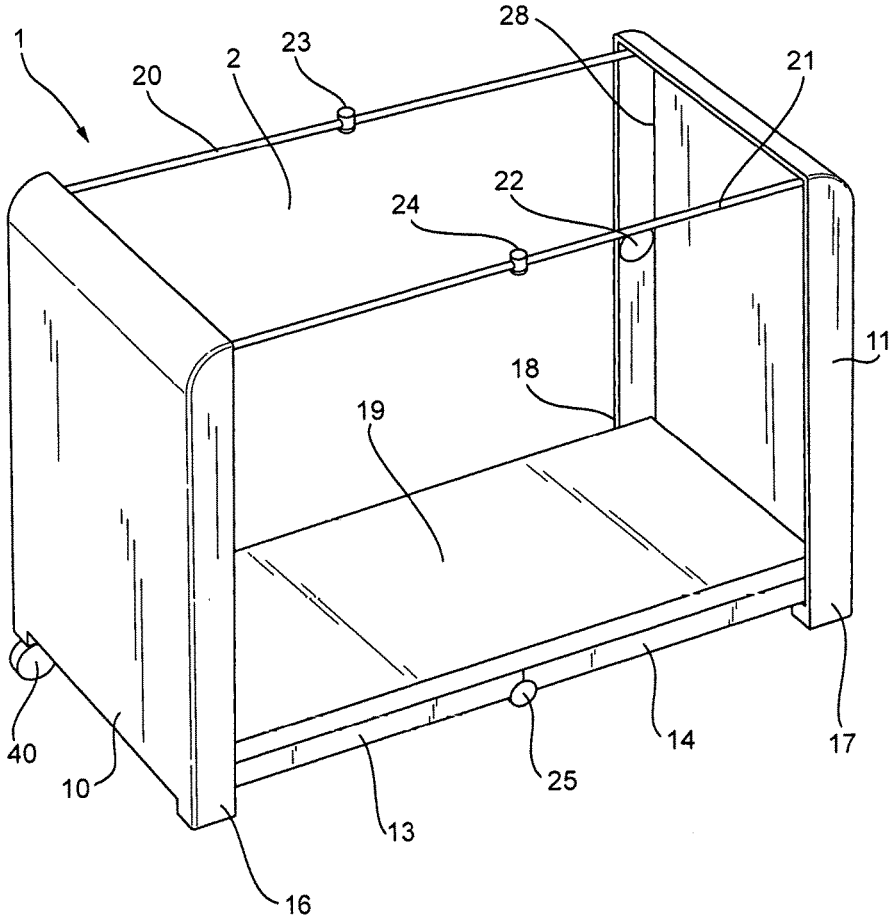
FIGS. 2A and 2B show alternate foldable cots according to embodiments.

A mattress 19, as shown in FIG. 2A, may be placed on the base 12. However, it is to be understood that the mattress 19 may be integral with the base 12, and may include a folding portion to correspond with the hinge 15, 25 so that it does not impede the folding of the base 12 of the cot 1.

Figure 2B:
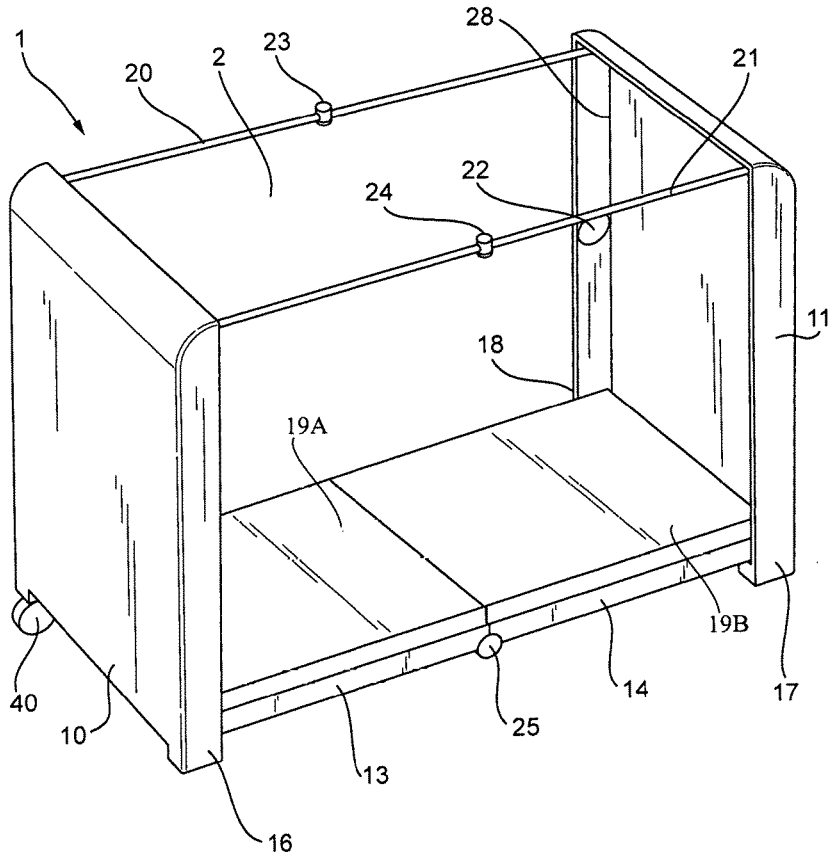

Alternatively, as shown in FIG. 2B, the mattress 19 may be formed of two parts 19A and 19B, each of which may be shaped to fit within the first and second base portions 13, 14, such that the base 12 of the cot 1 may be folded about the hinge 15, 25 without hindrance. Additionally, the first and second ends 10, 11 may both include a foot portion 16, 17 which bears against the ground, and the base 12 of the cot may be separated from the foot portion 16, 17 of the first and second ends 10, 11. This may help prevent an occupant of the cot being too close to the ground by providing a gap between the occupant and the ground, which may prevent the occupant becoming too hot or too cold.

The gap between the underside of the base 12 and the ground may also be used to aid a user when moving the cot 1 from a deployed configuration to a stowed configuration, because, as discussed later, the user may push the underside of the base 12 upwards, causing the cot 1 to fold. Movement between the deployed and stowed configurations, and vice versa, is discussed in more detail later.

Moreover, feet (not shown) may be provided on the underside of the base 12 which prevent the base 12 from 'drooping' towards the ground when the cot 1 is in a deployed position and, particularly, when a baby or infant is in the cot 1. Feet may be placed either side of the hinge 15, 25, or may be formed as part of the hinge 15, 25.

One or both of the foot portions 16, 17 may include a wheel or castor 40, which is discussed in more detail later.

In the embodiments shown in FIGS. 1-3, 5, and 6, both of the side-bars 20, 21 include trailing portions 28 at each end thereof. The trailing portions 28 extend at 90° from the horizontal parts of the side-bars 20, 21, down towards the base 12 of the cot 1. The trailing portions 28 may extend beyond the rotatable fixings 22, as far as pivot points 18 formed in the ends 10, 11. The pivot points 18 are formed such that the end of the trailing portion 28 is captive in the pivot point 18, but may rotate freely.

This configuration may both increase the structural stability of the cot 1, and provide an additional pivot point for the side-bars 20, 21 to rotate about.

The pivot points 18, along with the rotatable fixings, may prevent the side-bars 20, 21 from rotating beyond approximately 90° with respect to the top of the ends 10, 11, which may ensure that movement of the cot 1 from the folded configuration to the deployed configuration and back again is simple, quick, and predictable.

Moreover, the distance between the pivot points 18 of the base 12 and the foot portions 16, 17 ensures that the base portion 12 may pivot unhindered with respect to the ends 10, 11 of the cot 1.

Figure 3:
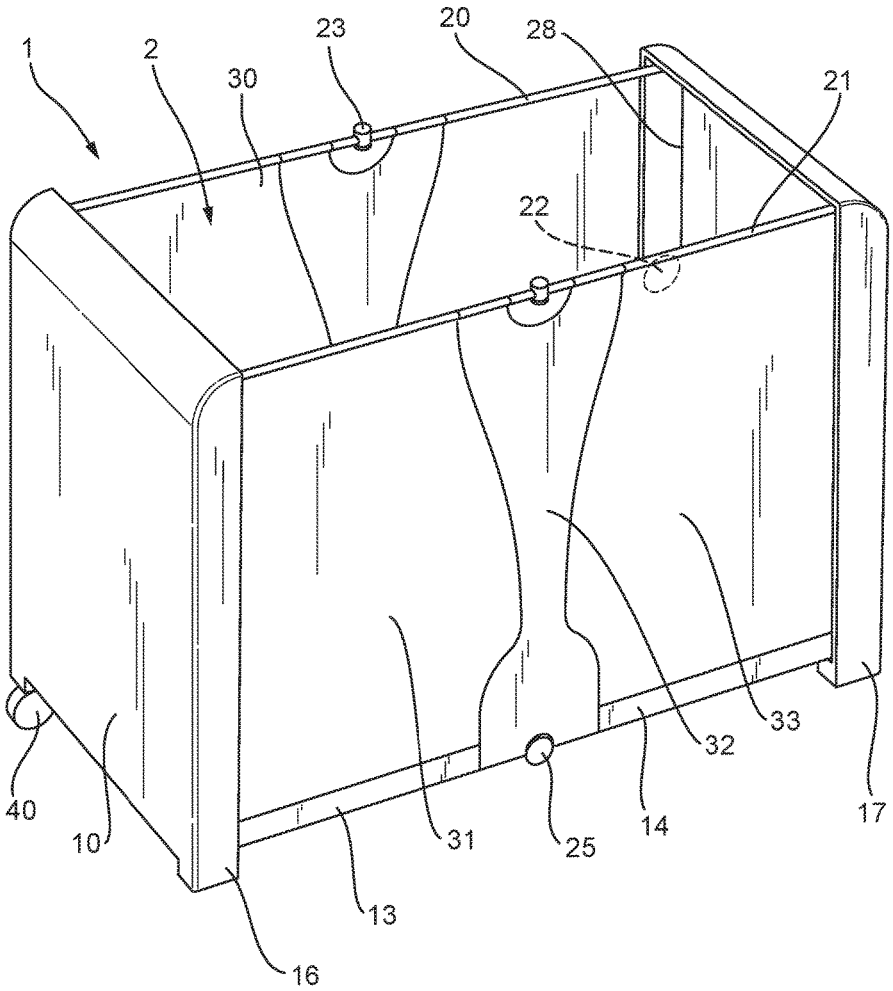
FIG. 3 shows a yet further alternate foldable cot according to an embodiment.
Figure 4:
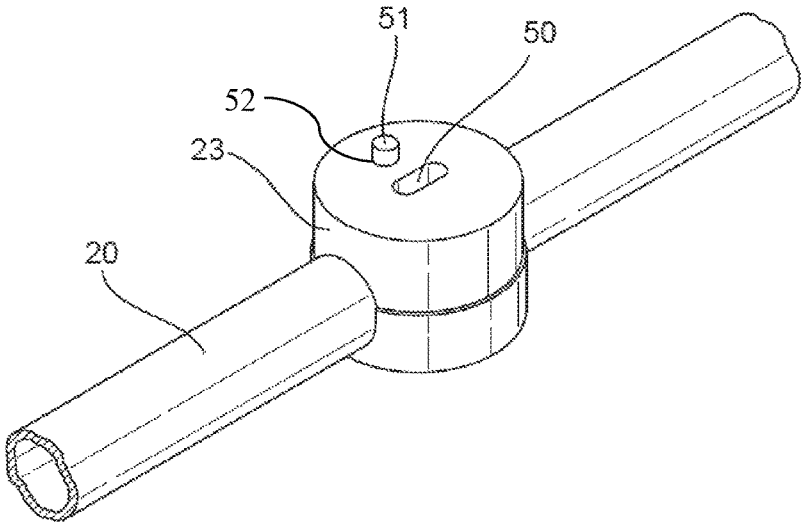
FIG. 4 shows a close-up view of a portion of the foldable cot shown in FIG. 1.

As seen in FIGS. 1-3 and in more detail in FIG. 4, the side-bars 20, 21 also include hinges 23, 24 at their respective mid-points, which enable the side-bars 20, 21 to fold inwards towards each other. To enable the cot 1 to fold efficiently, the first side-bar 20 may be further from the base 12, and therefore higher, than the second side-bar 21.

This configuration ensures that the two side-bars 20, 21 may fold inwards uninhibited without colliding with or contacting each other, and such that they may cross over. In combination with recesses provided in the ends 10, 11, this may ensure that the first and second ends 10, 11 can be brought together as closely as possible to reduce the overall footprint of the cot 1 when in the stowed configuration. The ends 10, 11 may include recesses shaped specifically for the side-bars 20, 21, or may preferably take a generally hollow configuration, such that the side-bars 20, 21 may be accommodated in the ends 10, 11 when the cot 1 is in a folded configuration.

With reference to FIG. 4, the hinges 23, 24 may further include a lock-out, to increase the rigidity of the structure of the cot 1 and may also prevent accidental folding of the side-bars 20, 21. This may serve to increase the safety of the cot 1. The lock-out may take the form of an over-center mechanism, or may include a latch or catch which locks the hinges 23, 24 in the open position. Alternatively, other types of lock-out or latch may be used which are capable of preventing accidental folding of the side-bars 20, 21 about the hinges 23, 24.

In an embodiment, the lock-out is a latching mechanism, as shown in FIG. 2. As can be seen, the hinge 23, 24 includes an upper portion and a lower portion, with the upper portion connected to the first part of one of the side-bars 20, 21, and the lower portion connected to the second part of one of the side-bars 20, 21. A pivot point 50 is provided which passes through the upper and lower portions of the hinge, and allows one part of the hinge 23, 24 to move with respect to the other part of the hinge.

It is to be understood that the first and second parts of the side-bar 20, 21 attached to the hinge, while attached to upper and lower portions of the hinge 23, 24, may be attached such that both first and second parts of the side-bar 20, 21 are at the same height.

To prevent the hinge 23, 24 from being folded, a spring-loaded member 51 may be provided in one part of the hinge 23, 24, with a corresponding recess 52 provided in the other part of the hinge 23, 24. When the hinge 23, 24 is in the position at which the cot 1 is deployed, the spring-loaded member 51 may pass protrude into (and through) the recess 52. The spring-loaded member 51 passing into the recess 52 prevents the hinge 23, 24 from being folded.

To fold the hinge 23, 24, a user may press the spring-loaded member 51 so that it no longer protrudes into (and through) the recess 52. The member 51 then no longer prevents folding of the hinge 23, 24, and while the user is pressing upon the member 51, the hinge 23, 24 may be folded. It is to be understood, however, that any suitable lock-out system may be used.

When the lock-outs of the hinges 23, 24 are engaged, the hinges 23, 24 may not move and therefore the side bars 20, 21 may not be folded. This ensures high rigidity of the cot when in the deployed position.

The hinges 23, 24 or side-bars 20, 21 may optionally be biased to start to fold inwards when the lock-outs are disengaged, for example by pre-tensioned side-walls 30, 31, by biasing at the pivot point 50, or similar.

Returning to FIG. 3, the side walls 30, 31 of the cot 1 preferably reach from the side-bars 20, 21 down to the base 12, each side-wall 30, 31 attached to the base and a respective side-bar 20, 21. The side-walls 30, 31 can be formed of flexible material, so that when the cot 1 is moved from a deployed configuration to a stowed configuration, the side portions 30, 31 do not inhibit the movement.

As seen in FIG. 3, the side-walls 30, 31 include a central portion 32 of flexible material, and portions 33 of mesh material. The flexible material 32 may be more durable than the mesh material 33, and may be positioned in-line with the side-bar hinges 23, 24, and the base hinges 15, 25, which may ameliorate degradation of the mesh material 33 when the cot 1 is moved between configurations.

It is to be understood, however, that solid side portions 30, 31 may be used, which may include folds, creases, or portions of flexible material 33 to allow the side portions 30, 31 to be folded when the cot 1 is moved from the deployed configuration to the stowed configuration, and vice versa.

Figure 7:
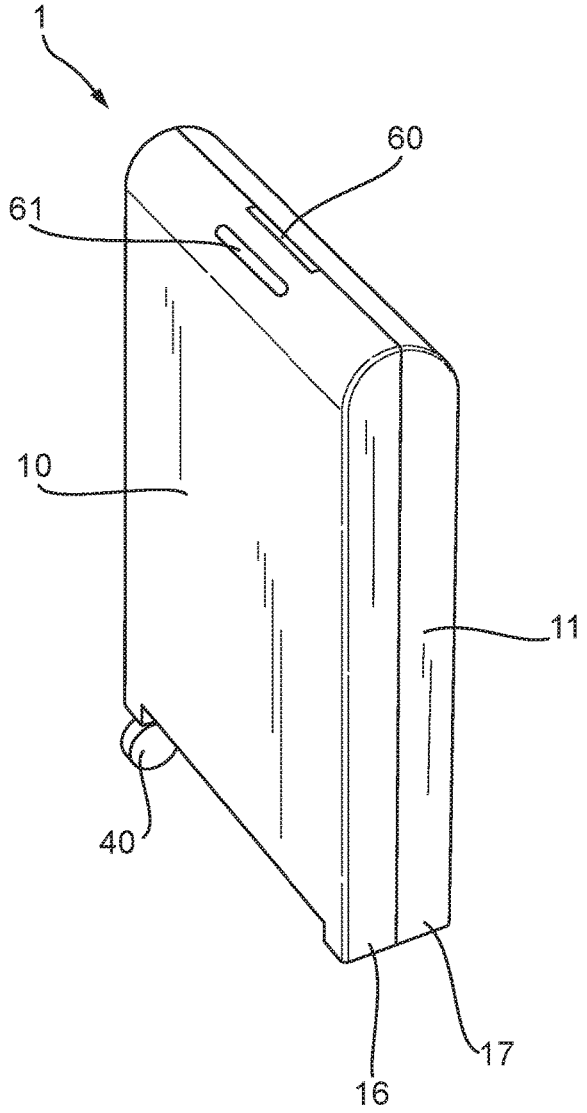
FIG. 7 shows a foldable cot according to an embodiment in a folded configuration.

Additionally, the ends of the cot 1 may include a clip mechanism 60 as shown in FIG. 7, along with a handle 61, such that the two ends of the cot may be attached together to give the folded cot a 'suitcase-like' form as shown in FIG. 7. This may enable easy storage and movement of the cot 1 whilst in a stowed configuration.

Figure 8:
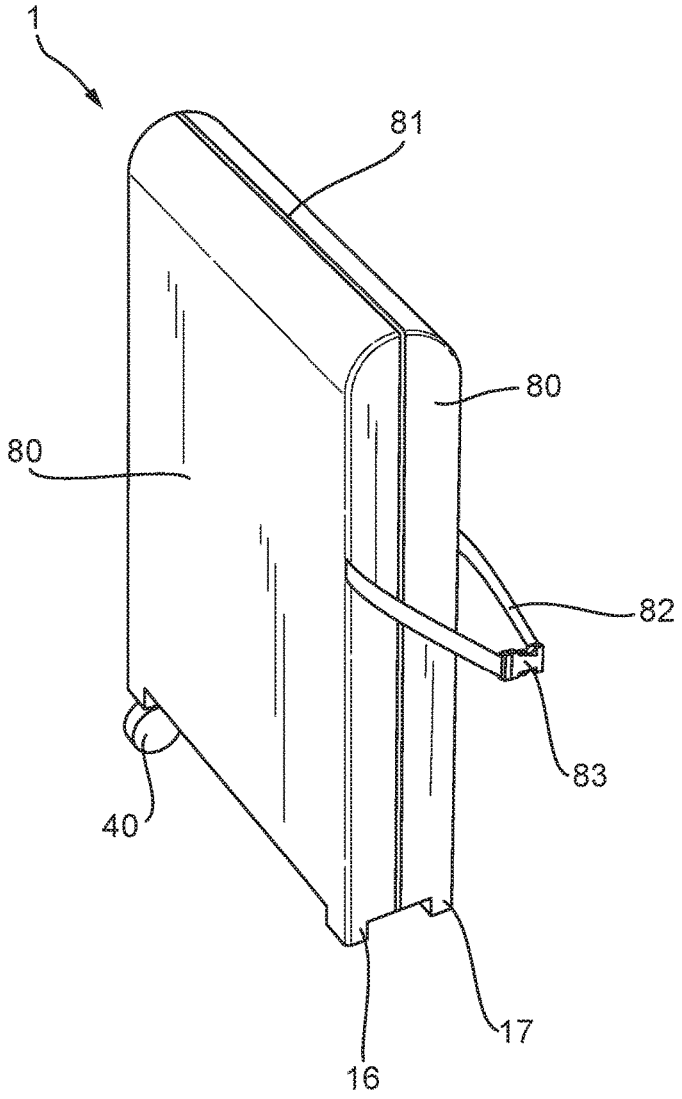
FIG. 8 shows an alternate foldable cot according to an embodiment in a folded configuration.

Alternatively, the ends 10, 11 of the cot 1 may be enclosed in a cover 80, which may be a two-part cover 80, the two parts of the cover 80 being attached together with a fixing mechanism 81, which may be a zipper or other suitable fastening mechanism, as shown in FIG. 8. The cover 80 may also include a handle 82.

To allow the two ends 10, 11 of the cot 1 to be separated and the cot moved from the stowed configuration into a deployed configuration, both the fixing mechanism 81 and the handle 82 are configured such that the two parts of the cover 80 may be fully separated from each other. The fixing mechanism 81 may be fully disengaged, and the handle 82 may be formed of two parts, with a clip 83 or similar provided to connect the two parts of the handle 82 together.

Further, the wheels or castors 40 at the foot portions 16, 17 may enable the cot to be moved easily when in the stowed configuration.

Figure 5:
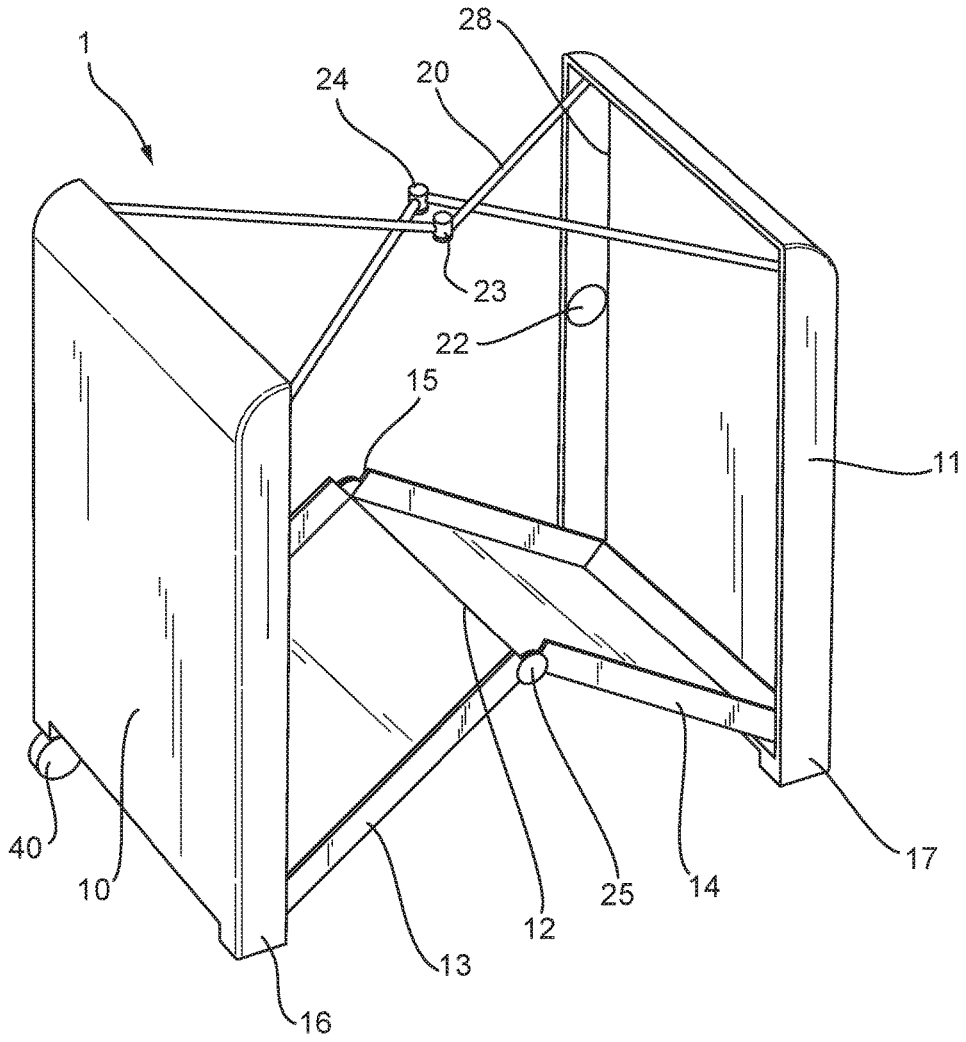
FIG. 5 shows a cot according to an embodiment partially folded.
Figure 6:
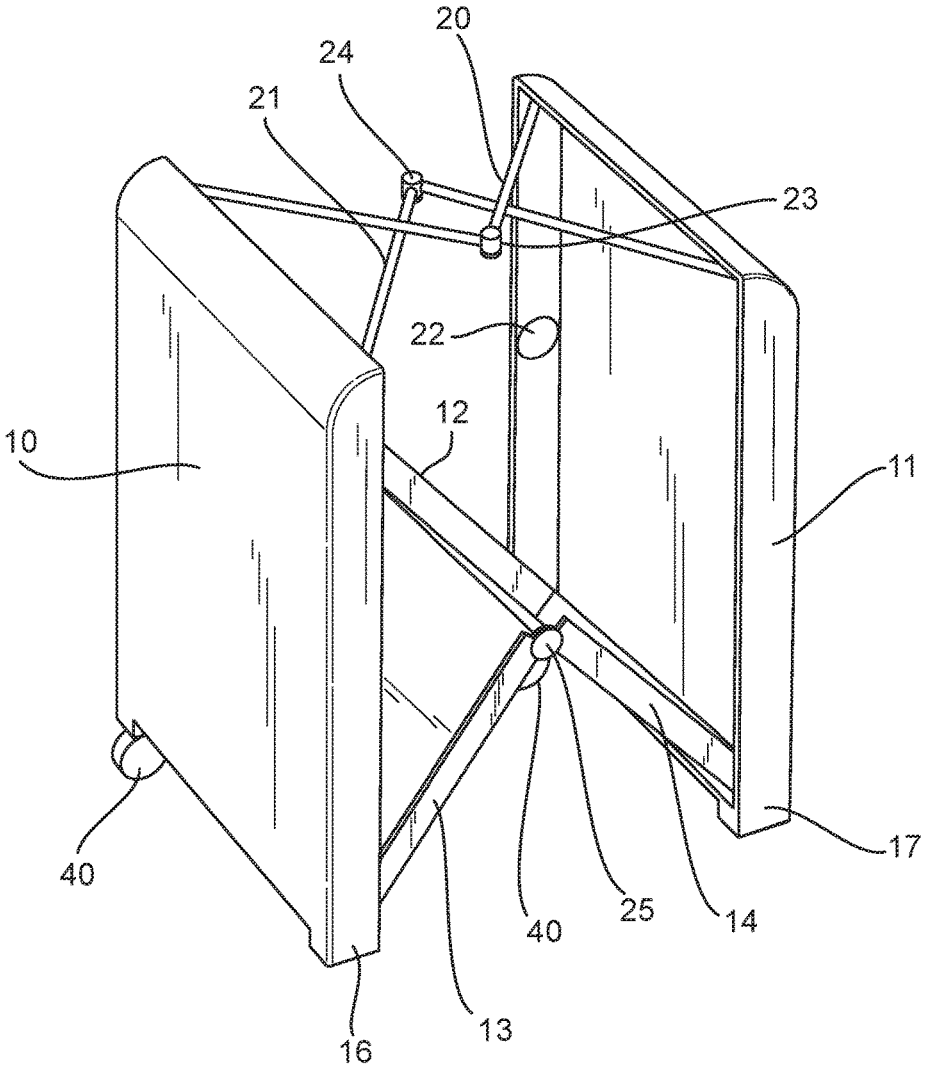
FIG. 6 shows the cot of FIG. 5 further through the folding process.

FIGS. 5 and 6 show the cot 1 in differing stages of folding. As can be seen, the two side-bars 20, 21 have been folded, and the base 12 has folded such that the central hinge of the base is folded upwards, towards the side-bars. Once the lock-outs of the side-bars have been disengaged, the base 12 may be lifted up by the user, likely with their foot, such that the base 12 begins to fold upwards. This causes the side-bars 20, 21, to fold fully inwards, and therefore the cot 1 to move from the deployed configuration into the stowed configuration.

As set out above, as the cot 1 is folded, the hinge 24 of the second side-bar 21 passes below the hinge 23 of the first side-bar 20, to enable the cot 1 to fold smoothly. This also prevents the need for a complex folding arrangement which could present a finger trap hazard.

As can be seen in FIG. 4, the side-bars fold in to the uppermost portion of the ends 10, 11, and the base 12 is accommodated in the space provided by the ends 10, 11 below the folded side-bars. The side portions 30, 31 fold over the base 12, and are accommodated within the remaining spaces in the ends 10, 11.

The folding operation may be synchronized, such that the upward folding of the base 12 causes the side-bars 20, 21 to fold, once the lock-outs have been released. The folding may be substantially quick, and may take of the order of 3 or 4 seconds to move from the deployed configuration into the stowed configuration.

In the embodiment shown in FIG. 7, the top edges 62 of the two ends 10, 11 clip together to prevent the cot 1 from unintentionally moving from the stored configuration to the deployed configuration (or indeed moving some way from the stored configuration) while being transported or stored.

Alternatively, or as well as shown in FIG. 8 and discussed above, the ends may be brought together and the two parts of the cover 80 being may attached together with a fixing mechanism 81, to prevent the cot 1 from unintentionally moving from the stowed configuration. In use, to move the cot 1 from the stowed configuration to the deployed configuration, the user would first position the cot 1 such that the feet 16, 17, and castors and/or wheels 40 of the ends 10, 11 are placed on the ground. Then, the user would disengage the clip 60 on the top edge of the ends 10, 11 (or the relevant fixing mechanism), to separate the two ends 10, 11. The user would then pull the two ends 10, 11 apart, causing the base 12 and the two side-bars 21, 22 (which would be folded) to move, both rapidly and in a synchronized manner, into an unfolded configuration. This would move the cot 1 into the deployed configuration.

When the side-bars 20, 21 are unfolded, the user would check whether the lock-out mechanism had been engaged, and if not, press upon the inner edges of the side-bars 20, 21 to move the lock-out mechanism of each side-bar into a locked configuration. The cot 1 would then be ready for use.

To move the cot 1 from the deployed configuration to the stowed configuration, the user would remove the occupant from the cot 1, and then also remove any bedding or other material stored within the cot 1. Then, the user would disengage the lock-outs of the side-bars 20, 21 as set out above. The user would then, likely with their foot, lift up the base 12 of the cot 1, such that the base 1 folds about the hinge 15, 25 and causing the side-bars 20, 21 to start to fold and the ends 10, 11 to start to come together.

The user would then push the two ends 10, 11 of the cot 1 together, which would cause the base 12 to continue folding upwards, and cause the side-bars 20, 21 to be folded inwards, towards each other. This would cause the cot 1 to fold, both rapidly and in a synchronized manner, such that the base 12 and the side-bars 20, 21, once completely folded, are accommodated in recesses in the ends 10, 11, and the ends 10, 11 may then be brought together and the clip 60 (or the relevant fixing mechanism) engaged, to retain the cot 1 in the stowed configuration.

When used in this specification and claims, the terms "comprises" and "comprising" and variations thereof mean that the specified features, steps or integers are included. The terms are not to be interpreted to exclude the presence of other features, steps or components.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilized for realizing embodiments in diverse forms thereof.

Thus, the foregoing embodiments have been described by way of example only. It will be appreciated by a person skilled in the art that various modifications can be made without departing from the scope of the claims. For example, the figures show that the first side-bar passes underneath the second side-bar, but this order can be swapped. Further, wheels or castors may be provided on the opposite end of the cot, or at both ends, or not at all.

The invention claimed is:

1. A foldable cot, the cot comprising:

a base attached to a first end and a second end;

first and second side-bars connected between the first and second ends above opposite sides of the base, wherein:

the first side-bar is positioned further from the base than the second side-bar;

the first and second side-bars are each hinged such that the first and second side-bars may fold toward one another;

the base is hinged so that the base may fold towards the first and second side-bars; and wherein the cot may be moved from a first configuration in which the base and the first and second side-bars are substantially un-folded into a second configuration in which the base is folded in the direction of the first and second side-bars, the first and second side-bars are folded such that the first side-bar folds directly above the second side-bar as the cot is moved from the first configuration to the second configuration, and the first and second ends are brought together with the folded base and the folded first and second side-bars therebetween.

2. The cot of claim 1, wherein the first and second side-bars are hinged at a mid-point.

3. The cot of claim 1, wherein the base is hinged at a mid-point.

4. The cot of claim 1, wherein the base is hinged parallel to the first and second ends.

5. The cot of claim 1, wherein the first and second side-bars are mounted such that the first and second side-bars may pivot with respect to the first and second ends.

6. The cot of claim 1, further comprising first and second side portions which are affixed to respective first and second side-bars and the base of the cot.

7. The cot of claim 6, wherein the first and second side portions include at least one section formed of a mesh material.

8. The cot of claim 6, wherein the first and second side portions include at least one section formed of a flexible material.

9. The cot of claim 1, wherein the hinges of the first and second side-bars may be locked in an unfolded position by way of respective first and second lock-outs when the cot is in the first configuration.

10. The cot of claim 9, wherein the first and second lock-outs include a spring-loaded locking member.

11. The cot of claim 10, wherein the spring-loaded locking member includes a protruding portion which is biased into a locked configuration.

12. The cot of claim 9, wherein the first and second lock-outs are over-center lock-outs.

13. The cot of claim 1, where the base further includes a mattress which may be folded with the base of the cot.

14. The cot of claim 13, wherein the mattress includes a hinged portion.

15. The cot of claim 13, wherein the mattress is formed of two parts.

16. The cot of claim 1, wherein the first and second ends include respective first and second foot portions positioned at or near the base of the cot.

17. The cot of claim 16, wherein at least one of the first and second foot portions includes a wheel or castor.

18. The cot of claim 1, wherein when the cot is in the second configuration, the base and the side-bars are accommodated in recesses provided in the first and second ends.

19. The cot of claim 1, wherein the base hinge is a living hinge.

20. The cot of claim 1, wherein the base hinge is a door-type hinge.

21. The cot of claim 1, wherein the first and second ends include a fixing mechanism such that, when the cot is in the second configuration, the first and second ends may be attached together.

22. The cot of claim 1, wherein the first and second ends include a cover, such that, when the cot is in the second configuration, the cover may be secured over the cot.

* * * * *